US007594835B2

(12) United States Patent
Gruenwald

(10) Patent No.: US 7,594,835 B2
(45) Date of Patent: Sep. 29, 2009

(54) SURFACE PIERCING PROPELLER TUNNEL

(75) Inventor: David Gruenwald, Allentown, WI (US)

(73) Assignee: Brooks Stevens Design Associates, Inc., Allentown, WI (US)

( * ) Notice: Subject to any disclaimer, the term of this patent is extended or adjusted under 35 U.S.C. 154(b) by 0 days.

(21) Appl. No.: 12/030,011

(22) Filed: Feb. 12, 2008

(65) Prior Publication Data

US 2008/0214067 A1 Sep. 4, 2008

Related U.S. Application Data

(60) Provisional application No. 60/889,592, filed on Feb. 13, 2007.

(51) Int. Cl.
*B63H 5/16* (2006.01)

(52) U.S. Cl. ..... 440/69; 114/288

(58) Field of Classification Search ..... 440/68, 440/69; 114/288, 291

See application file for complete search history.

(56) References Cited

U.S. PATENT DOCUMENTS 3,342,032 A 9/1967 Cox et al.
4,609,360 A * 9/1986 Whitehead ..... 440/69
4,689,026 A 8/1987 Small
6,045,420 A 4/2000 Small et al.
6,193,573 B1 2/2001 Small
6,213,824 B1 4/2001 Small
6,260,503 B1 7/2001 Allison
6,293,218 B1 9/2001 White
6,406,341 B1 6/2002 Morejohn
7,311,059 B2 12/2007 Loui et al.
6,863,013 B2 3/2008 Noyes

* cited by examiner

*Primary Examiner*—Stephen Avila
(74) *Attorney, Agent, or Firm*—McHale & Slavin, P.A.

(57) ABSTRACT

An improved tunnel configuration for tunnel mounted surface piercing propellers. The improved tunnel configuration provides a flooding suction to the tunnel to allow flooded propeller operation at speeds below planning. The tunnel is stepped whereby an upper portion of the tunnel is sized to allow the propeller to draw air at high speeds. The lower portion of the tunnel is sized to allow the propeller to be flooded resulting in smooth acceleration, improved handling in forward and reverse and a reduction of the transition period.

13 Claims, 9 Drawing Sheets

X=1.20-2.0D

D=PROPELLER DIAMETER

X=1.05-1.10D

IMPROVED TUNNEL DESIGN
32

32
38
39

FLOW TO PROPELLER DURING ACCELERATION
TUNNEL AS TAUGHT BY SMALL
TRANSOM VIEW
18
13
12

12
TURBULENT FLOW AREA
18
19

FLOW TO PROPELLER AT TOP SPEED

SURFACE PIERCING PROPELLER TUNNEL

PRIORITY APPLICATION

This application claims the benfit under 35 U.S.C. 119(e) of U.S. Provisional Patent Application No. 60/889,592 filed Feb. 13, 2007, entitled MODULAR OCULAR MEASUREMENT SYSTEM, the entirety of which is incorporated herein by reference.

FIELD OF THE INVENTION

This invention is directed to the field of watercraft, and in particular to an improved tunnel for housing surface piercing propellers.

BACKGROUND OF THE INVENTION

The use of surface piercing propellers to increase the efficiency of watercraft is known in the industry. Inventor Small adapted such use into a tunnel design, as disclosed in U.S. Pat. Nos. 4,689,026; 6,045,420; 6,193,573; and 6,213,824, all of which are incorporated herein by reference. These patents claim various tunnel configurations for the use of such propellers in shallow draft vessels. Specifically U.S. Pat. No. 6,213,824 teaches a tunnel that raises the propeller vertically to reduce draft. This patent has an inlet ramp or chute that feeds water flow to the propeller when the craft is moving forward on plane.

Surface piercing propellers operate efficiently when a portion of the blade breaks the surface of the water. Shallow draft vessels that employ these propellers housed within a tunnel rely upon a configuration that allows air to be placed in a position directly before the propellers. Through proper tunnel design, the propellers operate as an air pump drawing the air through a conduit. The shape of the tunnel is calculated to provide efficient operation at cruising and/or top speed.

In the teachings of Small, the shape of the tunnel around the surface piercing propeller is just slightly larger in width than the propeller diameter. If the tunnel width is too wide then the ability of the propeller to act like a pump begins to decrease. If the tunnel width is too narrow, inadequate water may lead to excess propeller ventilation. Unique to the tunnel shape of Small is an inlet ramp, or chute, along the leading edge which directs water up to meet the propeller. While the prior art tunnels allow for very efficient vessel operation while on plane, the tunnel design does not provide efficient operation when the vessel is traveling beneath planning speeds or transitioning from off plane to on plane operation. More specifically, the tunnel design of Small fails to provide adequate water flow to the propeller during acceleration.

When forward motion is inadequate for the chute to direct water into the tunnel, the required water must come from in front of and below or in front of and from the sides of the propeller. The current tunnel design inhibits the flow of water during a transition stage from idle to planning, resulting in poor acceleration. The result is known as propeller blow out, or excess propeller slip.

Thus, what is needed is a tunnel configuration that employs the benefits of the surface piercing propellers for shallow draft vessels but addresses the problem of propeller slip.

SUMMARY OF THE INVENTION

The present invention is an improvement upon the prior art shallow draft configurations such as those set forth in U.S. Pat. Nos. 4,689,026; 6,045,240; 6,193,573; and 6,213,824.

The shallow draft configuration employs the use of a surface piercing propeller placed in a tunnel that runs longitudinally in the bottom of the watercraft. The placement effectively eliminating the likelihood of underwater impact and improving shallow water operation without encountering the high efficiency loses normally associated with other shallow draft drive systems or water jets.

The improvement of the instant invention is directed to the shaping of the tunnel and in particular to the forming of a chamfered or radiused corner that improves water flow before the watercraft is on plane. The chamfered corner design allows water to flow into the flow field of the propeller disk providing smooth acceleration.

An objective of this invention is to teach the use of a tunnel mounted surface piercing propeller wherein the tunnel has a stepped side wall. Above the step the tunnel is 3-10% larger than the diameter of the propeller; below the step the tunnel can widen to any size without affecting operation efficiency.

Another objective of this invention is to teach the use of a tunnel mounted surface piercing propeller wherein the tunnel has a generally vertical side wall. The width of the tunnel above and below the centerline of the propeller is about 3-10% larger than the diameter of the propeller. At the intersection of the vertical side wall of the tunnel and the planning surface of the hull we place a radius or a chamfer that is larger than that required to accommodate manufacturing considerations.

Another objective of this invention is to teach the use of a tunnel mounted surface piercing propeller wherein the width of the tunnel above and below the centerline of the propeller is about 3-10% larger than the diameter of the propeller and the width of the tunnel aft of the propeller widens to improve the flow of water into the propeller disk when in reverse.

Still another objective of this invention is to teach the use of a tunnel mounted surface piercing propeller wherein the roof of the tunnel aft of the propeller slopes down until the trailing edge of the roof is at or below the free surface of the water when the vessel is at rest. The roof serving to stop air from entering the propeller when the vessel is operating in reverse.

Still another objective of this invention is to teach the use of a tunnel mounted surface piercing propeller wherein the roof of the tunnel aft of the propeller slopes down until the trailing edge of the roof is at or below the free surface of the water when the vessel is at rest, the tunnel roof being formed by a hinged panel that drops down in reverse and lifts up when the vessel is going forward. The hinged roof serving to stop air from entering the propeller when the vessel is operating in reverse and swings up to reduce drag when the vessel is moving forward.

Still another objective of the invention is to teach an improvement to tunnel configuration that allows water entry to the propeller in reverse by adding a second chamfer to the side walls of the tunnel aft of the propeller disk.

Still another objective of this invention is to increase reverse thrust by shaping the tunnel roof so as to greatly reduce the amount of air being introduced into the propeller disk when operating in reverse.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENT

The instant invention is directed to the shaping of the tunnel used in housing surface piercing propellers to enable water flow into the tunnel during acceleration and reverse. In particular, there are three ways to achieve the required flow improvement to the propeller disk during acceleration: chamfering, radiusing or stepping the side walls of the tunnel starting at a point that is approximately level with the center line of the propeller. This allows the surface piercing propeller to function well when on plane and moving forward at speed as an air pump, with all the same advantages as described by the prior art. In addition, since the preferred embodiment of the shallow draft tunnel configuration can result in the propeller blades actually being out of the water when the craft is at rest there is a need to find a way to reduce the flow of air into the propeller disk. The instant invention teaches a tunnel roof that can be either fixed or pivotal in nature and extends below the static waterline of the vessel.

Figure 1A:
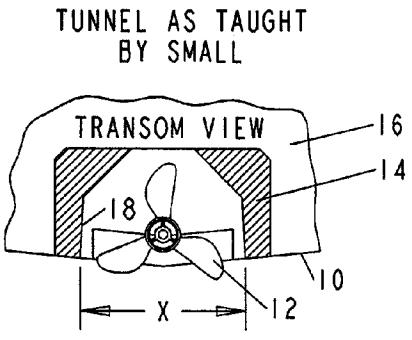
FIG. 1A PRIOR ART
FIG. 1A is a pictorial end view of a prior art tunnel configuration.
Figure 1B:
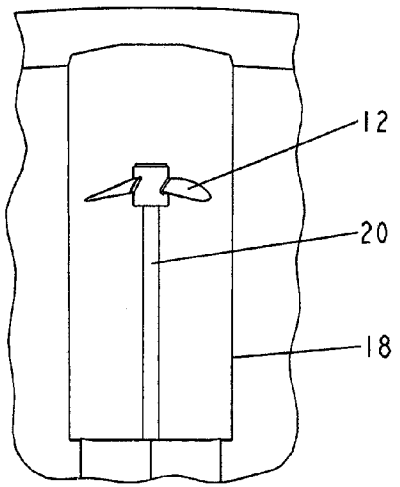
FIG. 1B PRIOR ART
FIG. 1B is a bottom view of FIG. 1A.

Referring now to the figures, FIG. 1A depicts a vessel (10) having a surface piercing propeller (12) placed within a tunnel having a width X as disclosed in the prior art. "X" varies from a few percent larger than the diameter of the propeller to approximately 10 percent larger than the diameter of the propeller. Conduit air vents (14) extend from the transom (16), or any other suitable location on a vessel, to a position in front of the propeller effectively filling the vacuum formed in front of the propeller allowing the water level in the tunnel to drop so the propeller can operate in the surface piercing mode where it is most efficient. The side walls (18) of the tunnel extend in a straight and approximately vertical wall along each side of the propeller. FIG. 1B is a bottom view further depicting the side wall (18) as a straight side wall, the propeller (12) coupled to a drive source by shaft (20)

Figure 2A:
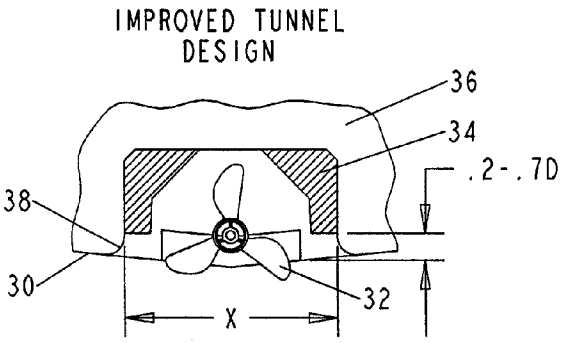
FIG. 2A is a pictorial end view of the improved design tunnel configuration.

FIG. 2A depicts the use of a vessel (30) having a surface piercing propeller (32) placed within a tunnel having width D of the improved design where the side air vents are "stepped". It has been found that the width of the tunnel in a plane above the centerline of the propeller should be 3 to 10 percent larger than the diameter of the propeller. The width of the tunnel in a plane below the center line of the propeller can also be 3 to 10 percent larger than the diameter of the propeller or even larger dependent on desired performance characteristics. In this configuration, a shortened air vent conduit (34) again draws air from the transom (36) of a vessel to a position before the propeller in a similar manner to the prior art. As shown in this embodiment the tunnel has a width located in a plane beneath the center line of the propeller X as disclosed, where "X" varies from ten percent larger than the diameter of the propeller to approximately two times larger than the diameter of the propeller. The propeller (32) continues to operate as an air pump in a similar manner as disclosed in the prior art. However, the disclosed shape further allows water to be drawn to the propeller by use of the stepped wall depicted by width X. In this configuration there is no need to chamfer or radius the lower corner of the tunnel side wall because the widened tunnel alone is sufficient to provide water flow to the propeller during acceleration. A disadvantage of this embodiment however is that the stepped air vents reduce planning surface in the aft section of the hull and while this may not be a detriment, and may even be an advantage on some hulls, other hull shapes may find this loss of planning area unacceptable and so in those cases it is preferable to bring the lower surface of the air vent down to the planning surface of the hull and chamfer or radius its' inside edge.

Figure 2B:
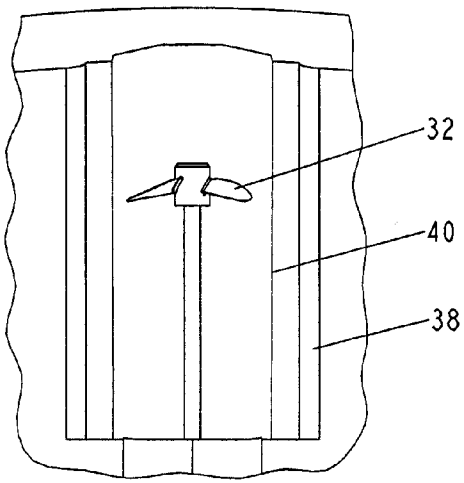
FIG. 2B is a bottom view of FIG. 2A.

FIG. 2B depicts the position of the stepped wall through radius (38) with the upper side position of the tunnel conforming to the teaching of the prior art and depicted by wall (40). The propeller (32) remains within the tunnel, the upper portion of the propeller surrounded by the tunnel shape disclosed in the prior art with a modification to the air vent conduit and stepping of the walls along the lower portion of the propeller. The result has been proven to provide the water flow necessary to provide smooth acceleration, and lessen the planning transition period.

Figures 3A, 3B, 4A, 4B:
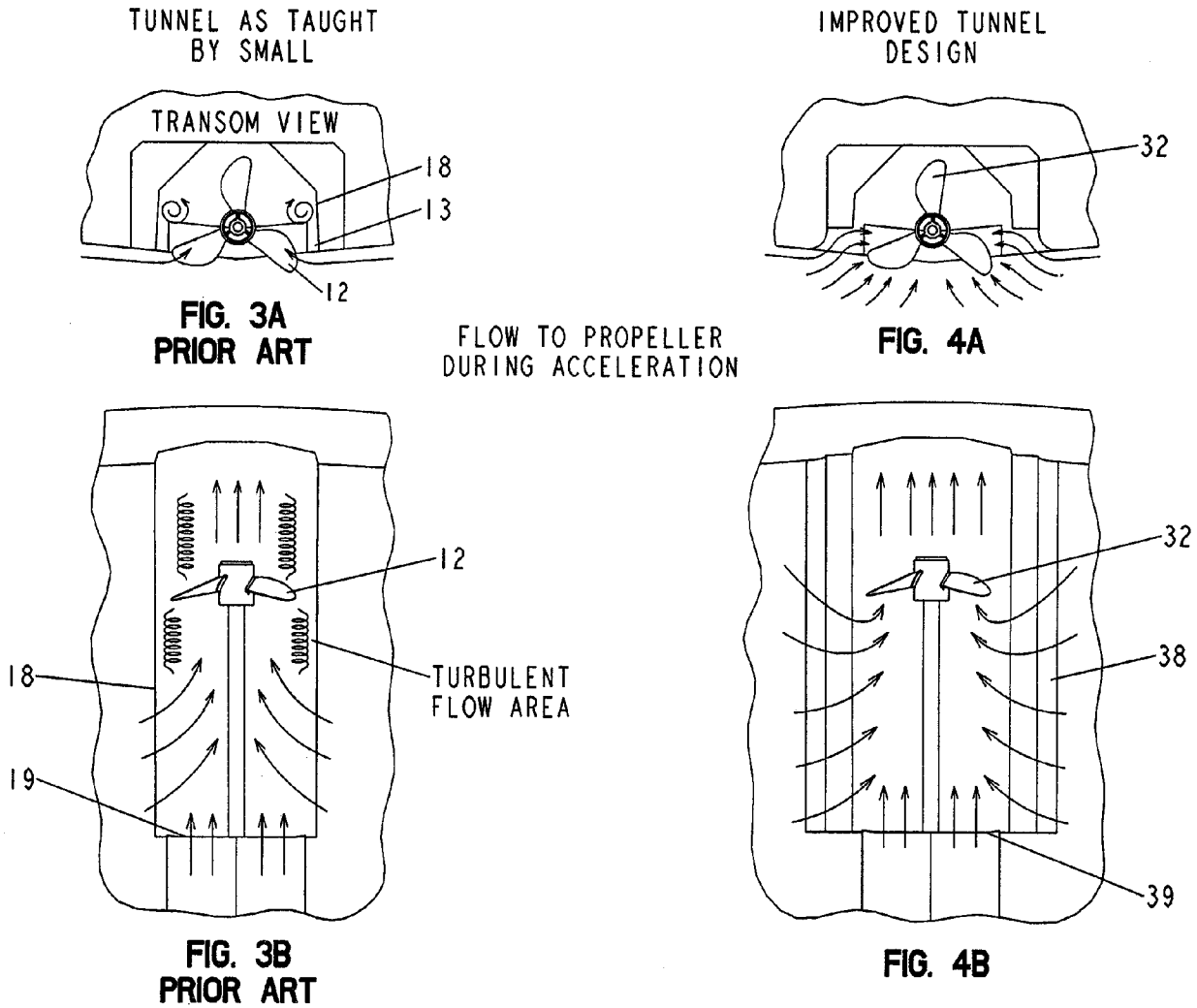
FIG. 3A PRIOR ART
FIG. 3B PRIOR ART
FIG. 3A is a pictorial end view of a prior art tunnel configuration illustrating water flow at acceleration.
FIG. 3B is a bottom view of FIG. 3A.
FIG. 4A is a pictorial end view of the improved tunnel design illustrating water flow at acceleration.
FIG. 4B is a bottom view of FIG. 4A.

FIGS. 3A and 3B depict a tunnel of the prior art with an illustration of water flow during acceleration. Water flow blockage (13) results in turbulence to the propeller (12) as a result of the straight vertical side wall (18) inhibiting water flow. At the lower speed, the chute forming along the leading edge of the tunnel is ineffective, the hull design actually prohibiting debris, as well as water, from reaching the propellers. The lack of water resulting in a turbulent flow along the tips of the propeller, resulting in slippage and poor acceleration.

As depicted in FIGS. 4A and 4B, the use of the stepped tunnel allows water flow to carry past the corner radius (38) and flood the tunnel with sufficient water to eliminate the turbulent flow area caused by the sharp tunnel walls.

Figure 5A:
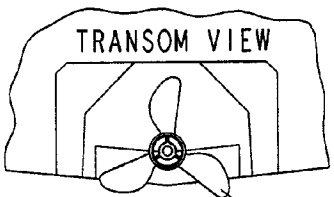
FIG. 5A PRIOR ART
FIG. 5A is a pictorial end view of a prior art tunnel configuration illustrating water flow at top speed.
Figure 5B:
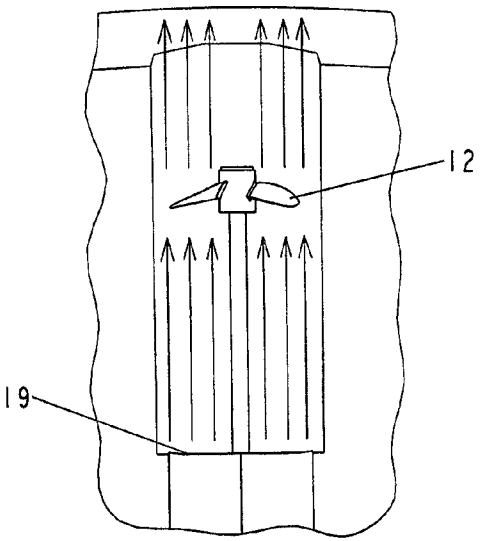
FIG. 5B PRIOR ART
FIG. 5B is a bottom view of FIG. 5A.

FIGS. 5A and 5B depict the efficiency of the invention of the prior art at speeds where a flow of water is delivered through the chute (19) directly to the propeller (12) and the efficiency of the super cavitating propeller is allowed to operate accordingly.

Figure 6A:
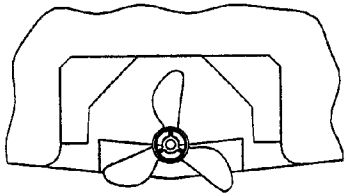
FIG. 6A is a pictorial end view of the improved tunnel design illustrating water flow at top speed.
Figure 6B:
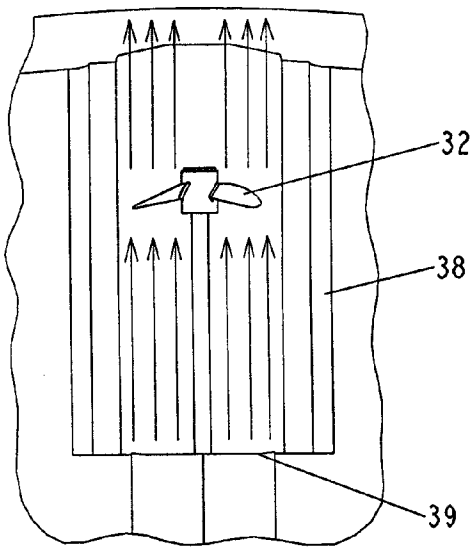
FIG. 6B is a bottom view of FIG. 6A.

Similarly, as depicted in FIGS. 6A and 6B the water to the propeller (32) of the instant invention tunnel shape provides the same efficiency, wherein the upper portion of the tunnel maintains the shape necessary for the propellers to operate as an air pump.

Figure 7A:
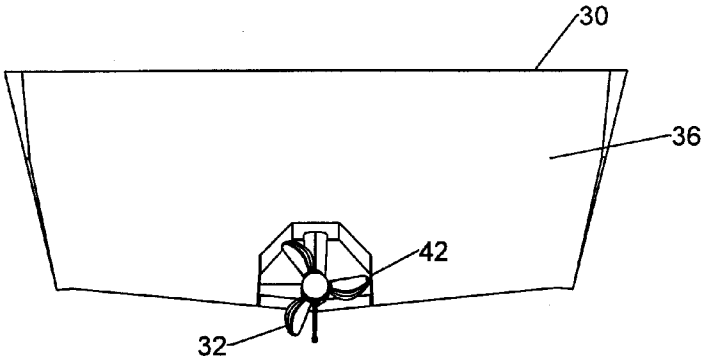
FIGS. 7A, 7B, 7C and 7D are various views of the tunnel showing the hull, and vessel propulsion system.
Figure 7B:
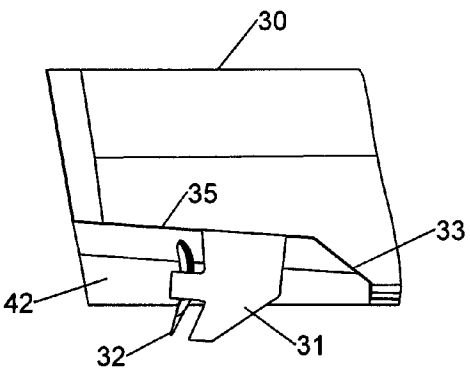
Figure 7C:
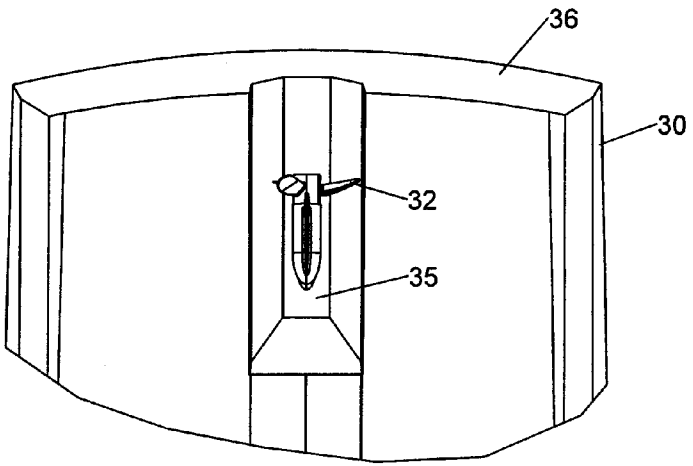
Figure 7D:
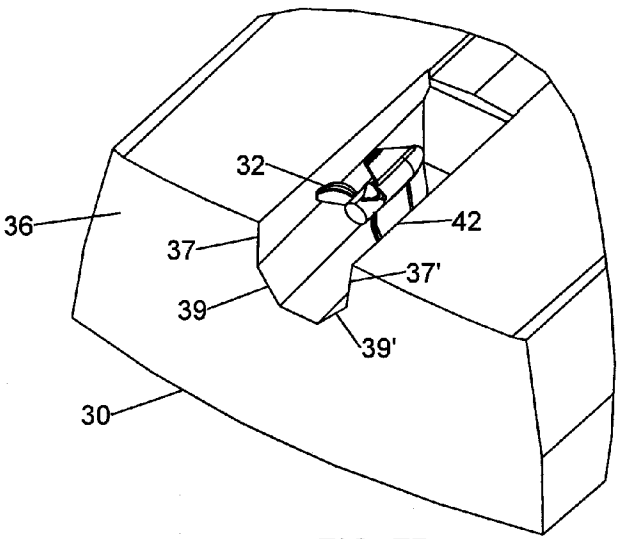

FIG. 7A is a rear view of a marine vessel having a surface piercing propeller 32 mounted on a unit 31. The unit is positioned aft an angled front wall 33 which extends to a fixed tunnel roof 35. Depicted is a transom 36, with the tunnel 42 further formed by opposition vertical side walls 37 & 37' and angled transition walls 39 & 39'. FIG. 7B shows a side view of the marine vessel 30 showing the relationship between the propeller 32 and the tunnel 42. FIG. 7C is a bottom view of the vessel showing the propeller 32 the tunnel 42 and the transom 36 of the vessel 30. FIG. 7D is a perspective view of the hull bottom showing the relationship between the hull bottom the tunnel 42, the propeller 32, and the transom 36. The exact positioning of the propeller in relation to the top and each side wall is dependent upon the size of the vessel and the power plant. It has been discovered that optimum efficiency is possible when the tunnel is 3-10% larger than the diameter of the propeller.

Figure 8B:
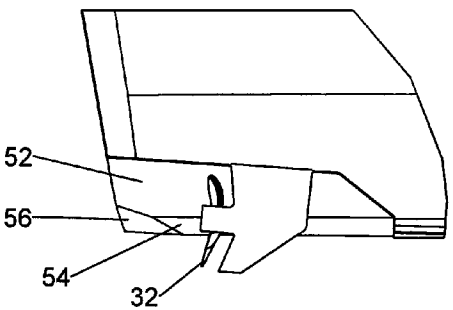
FIGS. 8A, 8B, 8C and 8D are various views of the improved tunnel showing the hull and vessel propulsion system with the chamfered corner design.
Figure 8D:
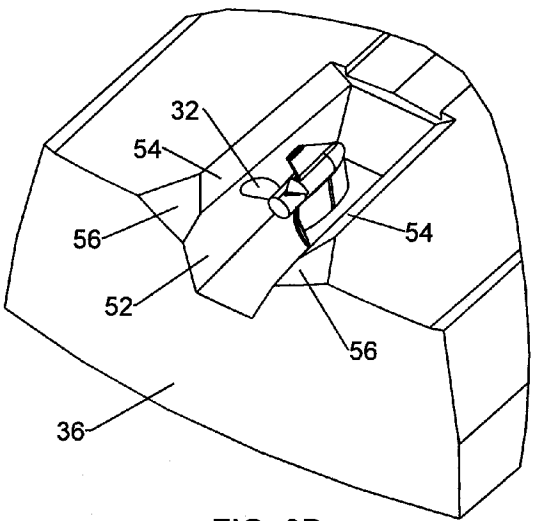
Figure 8A:
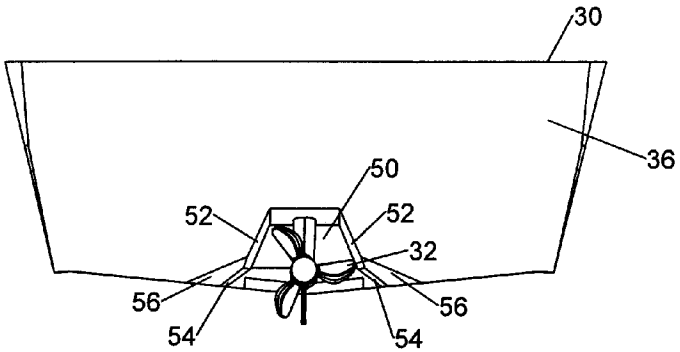
Figure 8C:
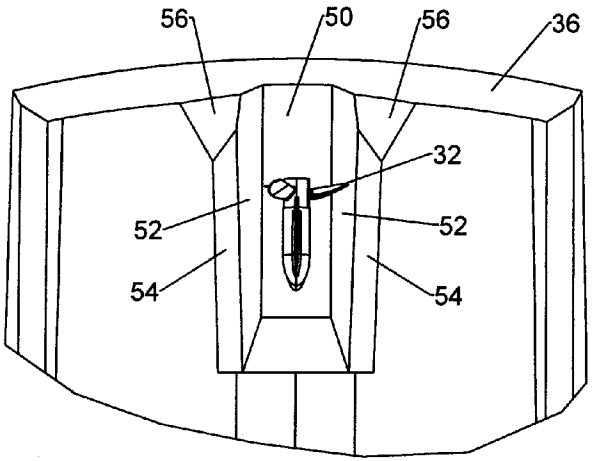

FIG. 8A is a rear view of the marine vessel showing the transom 36, the tunnel 50 and the propeller 32. The tunnel 50 has opposing side walls 52 and chamfered transition sections 54 that extend from the side walls 52 to the hull bottom. As shown at 56 the tunnel is widened aft of the propeller to facilitate the flow of water to the propeller disk when operating in reverse. FIG. 8B shows a side view of the marine vessel 30, shown in FIG. 8A, showing the relationship between the propeller 32, and the tunnel 50 with the chamfered transition section 54. FIG. 8C is a bottom view of the vessel showing the propeller 32 the tunnel 50 with the chamfered transition section 54. FIG. 8D is a perspective view of the hull bottom showing propeller 32, and the tunnel 50 with the chamfered transition section 54. Optimum efficiency is possible when the tunnel is 3-10% larger than the diameter of the propeller, or expressed in the range of in the range of 1.03 to 1.1 times the diameter of the propeller.

Figure 9B:
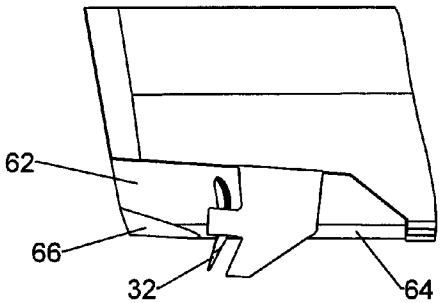
FIGS. 9A, 9B, 9C, and 9D are various views of the improved tunnel design showing the hull and vessel propulsion system with a radiused corner design.
Figure 9D:
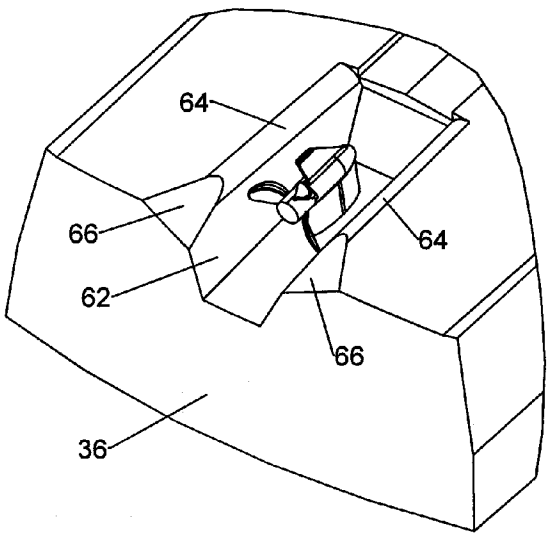
Figure 9A:
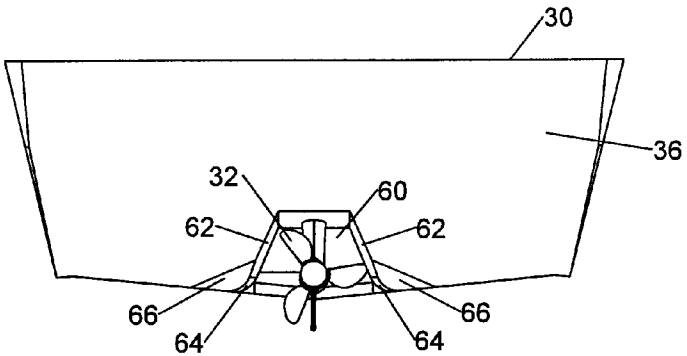
Figure 9C:
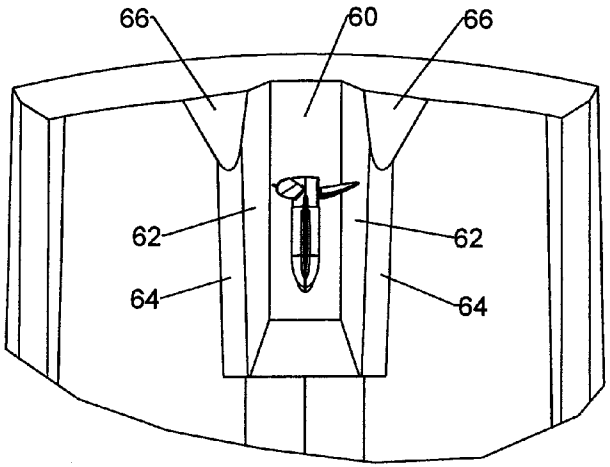

FIG. 9A is a rear view of the marine vessel showing the transom 36, the tunnel 60 and the propeller 32. The tunnel 60 has opposing side walls 62 and curved or radiused transition sections 64 that extend from the side walls 62 to the hull bottom. As shown at 66 the tunnel is widened aft of the propeller to facilitate the flow of water to the propeller disk when operating in reverse. FIG. 9B shows a side view of the marine vessel 30, shown in FIG. 9A, showing the relationship between the propeller 32, and the tunnel 60 with the curved or radiused transition section 64. FIG. 9C is a bottom view of the vessel showing the propeller 32 the tunnel 60 with the curved or radiused transition section 64. FIG. 8D is a perspective view of the hull bottom showing propeller 32, and the tunnel 60 with the curved transition section 64. Optimum efficiency is possible when the tunnel is 3-10% larger than the diameter of the propeller.

Figure 10B:
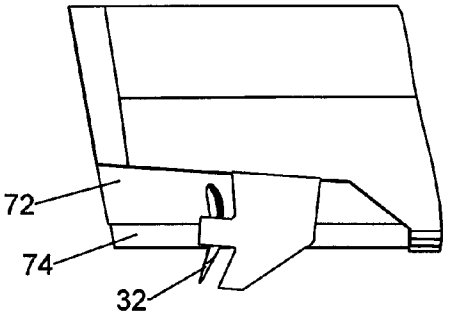
FIGS. 10A, 10B, 10C, and 10 D are various views of the improved tunnel design showing the hull and vessel propulsion system with a stepped side wall design.
Figure 10D:
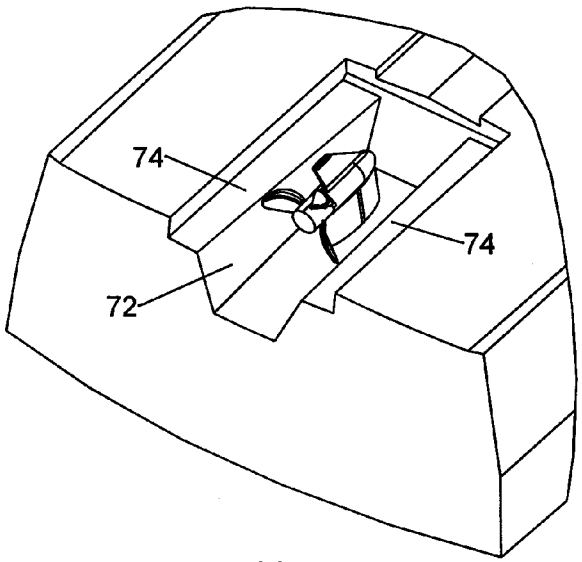
Figure 10A:
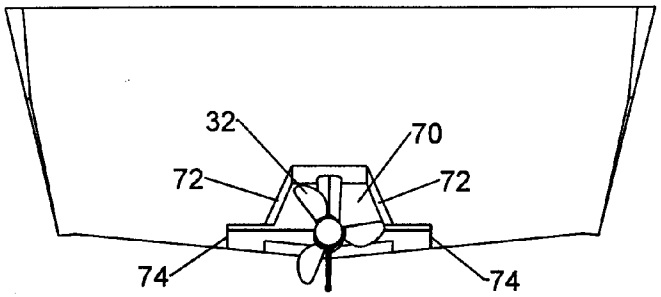
Figure 10C:
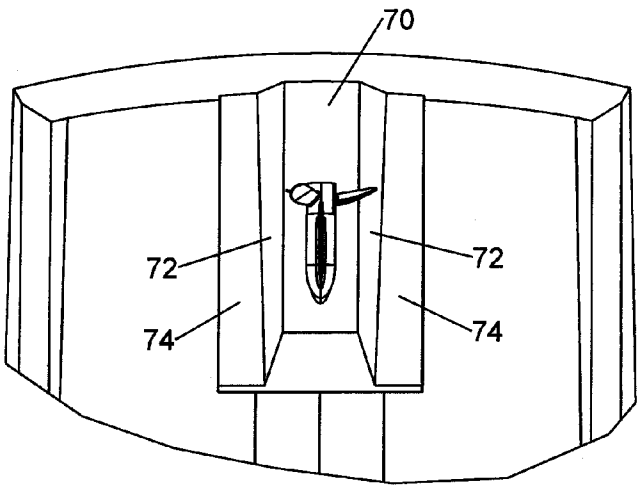

FIG. 10A is a rear view of the marine vessel showing the transom 36, the tunnel 70 and the propeller 32. The tunnel 70 has opposing side walls 72 and stepping transition sections 74 that extend from the side walls 72 to the hull bottom. FIG. 10B shows a side view of the marine vessel 30, shown in FIG. 10A, showing the relationship between the propeller 32, and the tunnel 70 with the stepped transition section 74. FIG. 10C is a bottom view of the vessel showing the propeller 32 the tunnel 70 with the stepped transition section 74. FIG. 10D is a perspective view of the hull bottom showing propeller 32, and the tunnel 70 with the stepped transition section 74. Optimum efficiency is possible when the tunnel is 3-10% larger than the diameter of the propeller.

Figure 11B:
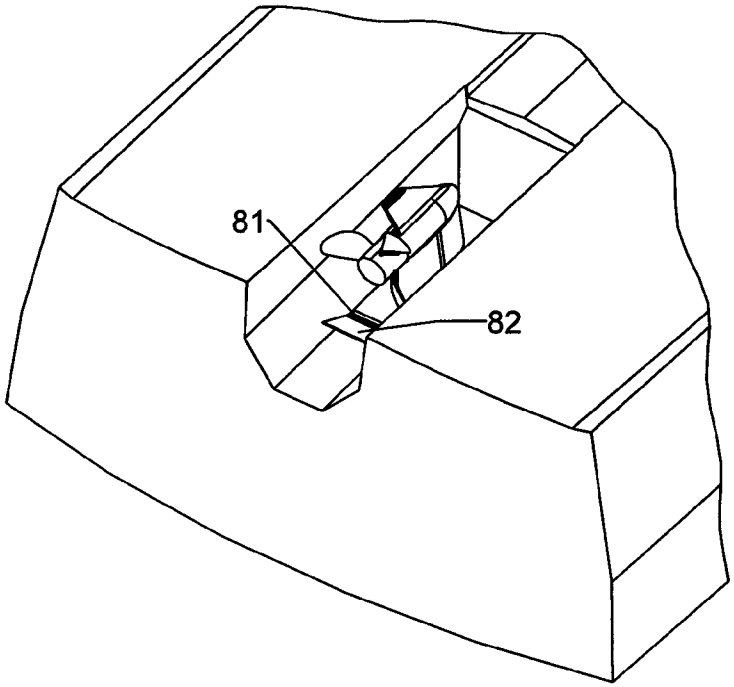
FIG. 11B is a prospective view of a hinged panel that drops down when the vessel is operated in reverse.
Figure 11A:
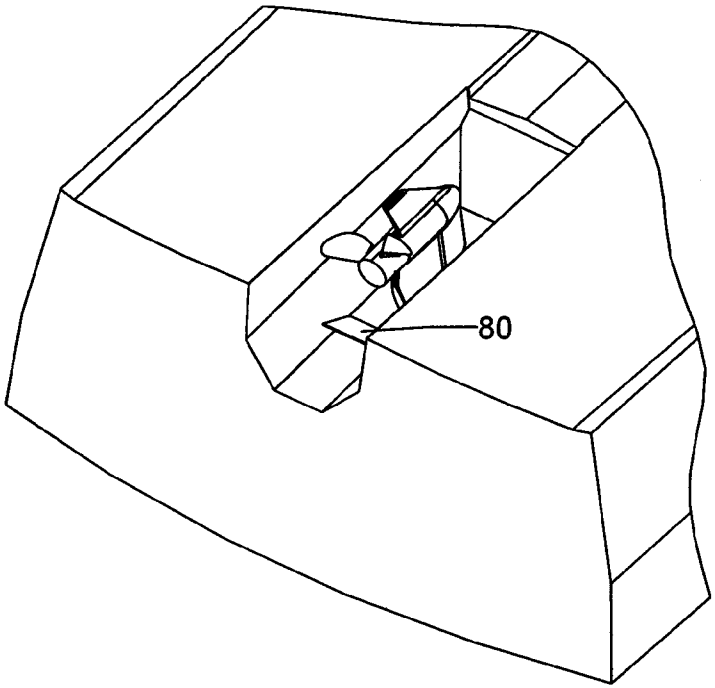
FIG. 11A is a prospective view of the tunnel roof that includes a fixed downwardly sloping tunnel roof aft of the propeller.

FIG. 11A shows a fixed sloping tunnel roof section 80 located aft of the propeller. The trailing edge of section 80 is at or below the free surface of the water when the boat is at rest. This roof section 80 stops air from entering the propeller when operating in reverse.

FIG. 11B shows an alternative embodiment to the tunnel roof section shown in 11A. In this embodiment the roof section aft of the propeller includes a hinged roof panel 82 that is pivotally coupled to the roof 81 by a hinge. The hinged roof panel drops down when the vessel is operated in reverse and is lifted up when the vessel is operated in the forward direction. This hinged roof panel 82 serves to stop air from entering the propeller when reversing and swings up to reduce drag when going forward. In the preferred embodiment, the hinged roof panel operates under water pressure provided as the vessel moves forward, forcing the hinged panel upward or when the vessel is moved backward, forcing the hinged panel downward. Alternatively the hinged roof panel can be operated by an electric or hydraulic ram.

Figure 12:
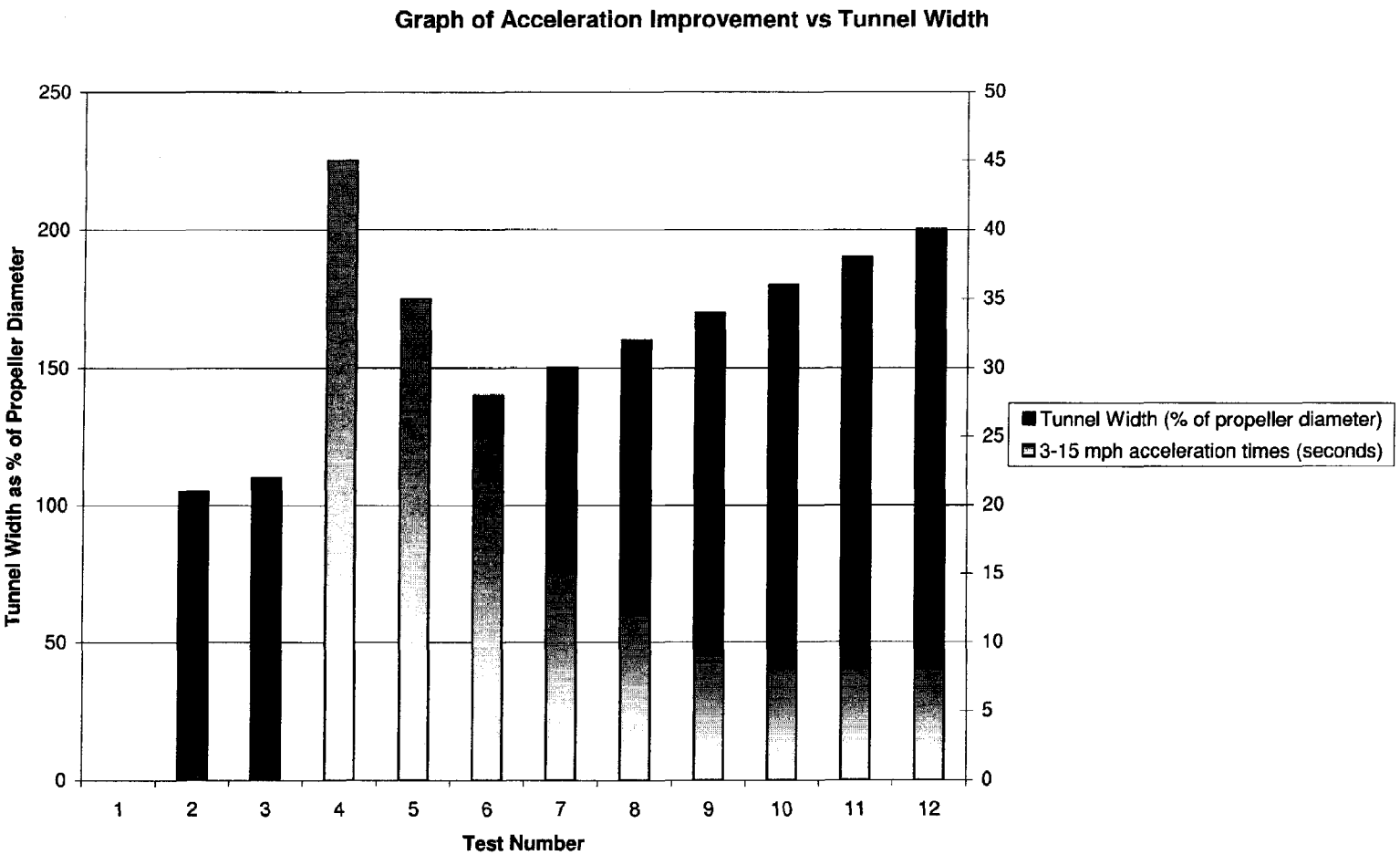
FIG. 12 is a graph of acceleration improvement versus tunnel width.

FIG. 12 is a graph of the acceleration improvement of the instant invention versus tunnel width. As the tunnel is widened, acceleration begins to drop off or decrease. This is illustrated by test numbers 412 in FIG. 12. The instant invention is illustrated by test numbers 2 and 3 in FIG. 12. The optimum efficiency, as demonstrated by acceleration, of the instant invention is achieved when the tunnel is 3-10% larger than the diameter of the propeller. This relationship between the diameter of the propeller and the tunnel width is illustrated in FIG. 12 by the scale on the left side of FIG. 12. The instant invention, test number 2 and 3, has a tunnel width of 103-110% of the propeller diameter. As illustrated in FIG. 12 the acceleration of the instant invention is 21-22 seconds. The prior art acceleration is far less than these times. The best acceleration of the prior art is about 28 seconds which is significantly slower that the acceleration of the instant invention. The best acceleration of the instant invention, test number 2, is 33% faster than the best acceleration of the prior art, test number 6. This demonstrates a significant improvement over the prior art.

It is to be understood that while I have illustrated and described certain forms of my invention, it is not to be limited to the specific forms or arrangement of parts herein described and shown. It will be apparent to those skilled in the art that various changes may be made without departing from the scope of the invention and the invention is not to be considered limited to what is shown in the drawings and described in the specification.

The invention claimed is:

1. In an engine driven marine vessel having a hull and at least one engine driven propeller operatively associated with a tunnel formed integral with said hull of said vessel, said tunnel having first and second surfaces which run generally parallel to a longitudinal axis of said vessel, said first surface and second surface being contiguous with a bottom side of said hull, a third surface running parallel to the longitudinal axis of the vessel being contiguous with said first and second surfaces and forming a roof of said tunnel; said first and second surfaces each further including at least one transition section which connects each of said first and second surfaces respectively, with the bottom of the hull of the vessel, said propeller being of a predetermined diameter, said first and second surfaces define a width of the tunnel, the width of said tunnel located at and above a center axis of said propeller being in the range of 1.03 to 1.1 times the diameter of the propeller, an air inlet connected to a vent, said vent in communication with said tunnel, said vent extending from a transom of said vessel to a location forward of the propeller, an additional air inlet in the transom, and an additional vent, said additional vent positioned generally parallel to the longitudinal axis of the vessel and is also in communication with said tunnel.

2. The engine driven vessel of claim 1, wherein the width of the tunnel located at and below a horizontal plane passing through a center axis of said propeller being in the range of 1.03 to 1.1 times the diameter of the propeller.

3. The engine driven vessel of claim 1, wherein the width of the tunnel located at and below a horizontal plane passing through a center axis of said propeller being in the range of 1.1 to 2.0 times the diameter of the propeller.

4. The engine driven vessel of claim 1, wherein the width of the tunnel located at and below a horizontal plane passing through a center axis of said propeller being greater than 1.1 times the diameter of the propeller.

5. The engine driven vessel of claim 1 wherein said transition section is a surface configured as a curved radius.

6. The engine driven vessel of claim 1, wherein said transition section is configured as a chamfered surface.

7. The engine driven vessel of claim 1, wherein said transition section is configured as a stepped surface.

8. In an engine driven marine vessel having a hull and at least one engine driven propeller operatively associated with a tunnel formed integral with said hull of said vessel, said tunnel having first and second surfaces which run generally parallel to a longitudinal axis of said vessel, said first surface and second surface being contiguous with a bottom side of said hull, a third surface running parallel to the longitudinal axis of the vessel being contiguous with said first and second surfaces and forming a roof of said tunnel; said first and second surfaces each further including at least one transition section which connects each of said first and second surfaces respectively, with the bottom of the hull of the vessel, said propeller being of a predetermined diameter, said first and second surfaces define a width of the tunnel, the width of said tunnel located at and above a center axis of said propeller being in the range of 1.03 to 1.1 times the diameter of the propeller, an air inlet connected to a vent, said vent in communication with said tunnel, said vent extending from a transom of said vessel to a location forward of the propeller, said air inlet extends from a horizontal plane generally located at the top wall of the tunnel and extends vertically to a horizontal plane generally passing through the axis of the drive shaft.

9. In an engine driven marine vessel having a hull and at least one engine driven propeller operatively associated with a tunnel formed integral with said hull of said vessel, said tunnel having first and second surfaces which run generally parallel to a longitudinal axis of said vessel, said first surface and second surface being contiguous with a bottom side of said hull, a third surface running parallel to the longitudinal axis of the vessel being contiguous with said first and second surfaces and forming a roof of said tunnel; said first and second surfaces each further including at least one transition section which connects each of said first and second surfaces respectively, with the bottom of the hull of the vessel, said propeller being of a predetermined diameter, said first and second surfaces define a width of the tunnel, the width of said tunnel located at and above a center axis of said propeller being in the range of 1.03 to 1.1 times the diameter of the propeller, an air inlet connected to a vent, said vent in communication with said tunnel, said vent extending from a transom of said vessel to a location forward of the propeller, said air inlet extends from a horizontal plane generally located at the top wall of the tunnel and extends vertically to a location adjacent the bottom surface of the hull.

10. In an engine driven marine vessel having a hull and at least one engine driven propeller operatively associated with a tunnel formed integral with said hull of said vessel, said tunnel having first and second surfaces which run generally parallel to a longitudinal axis of said vessel, said first surface and second surface being contiguous with a bottom side of said hull, a third surface running parallel to the longitudinal axis of the vessel being contiguous with said first and second surfaces and forming a roof of said tunnel; said first and second surfaces each further including at least one transition section which connects each of said first and second surfaces respectively, with the bottom of the hull of the vessel, said propeller being of a predetermined diameter, said first and second surfaces define a width of the tunnel, the width of said tunnel located at and above a center axis of said propeller being in the range of 1.03 to 1.1 times the diameter of the propeller, said tunnel width increases in a tunnel section aft of the propeller, whereby the flow of water into the propeller is improved when the vessel is driven in reverse.

11. In an engine driven marine vessel having a hull and at least one engine driven propeller operatively associated with a tunnel formed integral with said hull of said vessel, said tunnel having first and second surfaces which run generally parallel to a longitudinal axis of said vessel, said first surface and second surface being contiguous with a bottom side of said hull, a third surface running parallel to the longitudinal axis of the vessel being contiguous with said first and second surfaces and forming a roof of said tunnel; said first and second surfaces each further including at least one transition section which connects each of said first and second surfaces respectively, with the bottom of the hull of the vessel, said propeller being of a predetermined diameter, said first and second surfaces define a width of the tunnel, the width of said tunnel located at and above a center axis of said propeller being in the range of 1.03 to 1.1 times the diameter of the propeller, the roof of said tunnel aft of the propeller slopes down until the trailing edge of the roof is at or below the surface of the water when the boat is at rest, whereby the roof stops air from entering the tunnel when the vessel is operated in reverse.

12. The engine driven vessel of claim 11, wherein said roof of said tunnel aft of the propeller is fixed.

13. The engine driven vessel of claim 11, wherein said roof of said tunnel aft of the propeller is a hinged panel that drops down when the vessel is operated in reverse and lifts up when the vessel is operated in a forward direction.

* * * * *